US005542530A

United States Patent [19]

Freelander

[11] Patent Number: 5,542,530

[45] Date of Patent: Aug. 6, 1996

[54] SUSPENDED ADJUSTABLE SHELVING FOR GARMENT BAG

[75] Inventor: Robert C. Freelander, Portland, Oreg.

[73] Assignee: Richard's Homewares, Inc., Portland, Oreg.

[21] Appl. No.: 433,607

[22] Filed: May 3, 1995

[51] Int. Cl.[6] ..... B65D 85/18; A47B 57/00; A47F 5/10

[52] U.S. Cl. ..... 206/292; 108/96; 108/106; 108/149; 206/286; 211/117; 211/118; 211/187

[58] Field of Search ..... 211/113, 118, 211/119, 187, 117; 108/149, 96, 106; 206/282, 289, 298, 292, 290, 286, 297; 312/6

[56] References Cited

U.S. PATENT DOCUMENTS

| | | | |
|---|---|---|---|
| 2,016,520 | 10/1935 | Short | 206/289 |
| 2,244,887 | 6/1941 | Manley | 108/149 X |
| 2,845,185 | 7/1958 | Winderweedle, Jr. | 108/149 X |
| 3,184,273 | 5/1965 | Blough | 206/292 X |
| 3,572,251 | 3/1971 | Johnson | 206/290 X |
| 4,187,787 | 2/1980 | Nakatsu | 108/96 |
| 4,244,301 | 1/1981 | Nakatsu | 108/149 |
| 4,295,432 | 10/1981 | Hulke | 108/149 |
| 4,506,607 | 3/1985 | Jacoby | 108/60 |
| 4,736,855 | 4/1988 | Arakawa | 211/187 X |
| 5,071,003 | 12/1991 | Freelander | 206/282 |
| 5,143,214 | 9/1992 | Freelander et al. . | |
| 5,427,344 | 6/1995 | Beauchemin | 108/149 |

FOREIGN PATENT DOCUMENTS

| | | | |
|---|---|---|---|
| 0493288 | 5/1950 | Belgium | 108/149 |
| 1441450 | 5/1966 | France | 211/187 |
| 2458246 | 2/1981 | France | 108/149 |

*Primary Examiner*—Bryon P. Gehman
*Attorney, Agent, or Firm*—Chernoff, Vilhauer, McClung & Stenzel

[57] ABSTRACT

Adjustable shelving which may be suspended from a cross-member includes a plurality of shelves suspended at desired levels from at least four vertical suspenders. Each shelf has at least four apertures through which respective vertical suspenders pass. For each shelf, a set of adjustable shelf fasteners is used to support the shelf by releasably attaching fasteners to respective suspenders at the desired location to support respective corners of the shelves. The vertical suspenders may include a pair of ropes which may be inserted into a pair of apertures in the fasteners. The shelving may be enclosed in an exterior garment bag.

19 Claims, 3 Drawing Sheets

SUSPENDED ADJUSTABLE SHELVING FOR GARMENT BAG

BACKGROUND OF THE INVENTION

The present invention relates to suspended shelving and, more particularly to suspended adjustable shelving.

Suspended shelving is often used in closets for storing a variety of items such as sweaters and shoes. Such suspended shelving provides additional "shelf" space by suspending shelves directly or indirectly from a closet clothes rod. Typically, suspended shelving includes at least two side panels and multiple "fixed" shelves. The side panels and shelves of typical suspended shelving are generally plastic or fabric. The shelves are permanently attached or joined to the side panels by gluing, stitching, sonic welding, or heat sealing. One or more additional panels such as back and front panels are often used to further enclose and protect the shelving.

In conventional suspended shelving, because the shelves are generally fixed to the side panels, the height and quantity of the shelves is predetermined. The predetermined height, however, may not be optimal for the intended use of the shelves. If the predetermined height is too high, valuable space may be wasted because the shelf will not be full. If the predetermined height is too low, items such as bulky sweaters may not fit on the shelf. Further, it is impossible to add additional shelves to conventional fixed shelving.

Another problem with conventional suspended shelving is lack of durability. It is not uncommon for the shelves to be torn from the side panels due to the weight of the items stored, the material used to construct the shelving, or the method used to join the shelves to the side panels.

Another type of suspended shelving includes approximately four ropes which directly or indirectly attach to a closet clothes rod. Shelves are suspended from the ropes using permanently attached metal clamps or securers which are fastened to the ropes at predetermined heights. In addition to the problems associated with having the height and quantity of the shelves predetermined, it is also difficult to assure that the clamps on the ropes are set at uniform heights.

For the reasons discussed above, durable suspended shelving having shelves, the height and quantity of which may be easily adjusted, is needed.

SUMMARY OF THE INVENTION

The present invention overcomes the aforementioned deficiencies of the prior art by providing durable suspended shelving having shelves, the height and quantity of which may be easily adjusted.

In accordance with the present invention, adjustable suspended shelving which may be suspended from a cross-member or closet clothes rod includes a plurality of shelves adjustably suspended at desired heights from at least four vertical suspenders. Each shelf has at least four apertures through which respective vertical suspenders pass. For each shelf, a set of adjustable shelf fasteners is used to support the shelf at a desired location along the vertical suspenders. To do this, each fastener in a fastener set releasably attaches to a respective suspender at the desired location and the respective corners of the shelves are supported by the fasteners.

Each vertical suspender may include a pair of ropes and the fasteners may include a pair of apertures. A first rope of the pair of ropes passes through a first aperture of the pair of apertures, and a second rope of the pair of ropes passes through a second aperture of the pair of apertures.

The shelving may be enclosed in a garment bag which has at least three panels made of flexible material such as fabric or plastic. A fourth, at least partially removable, panel may be included in the exterior garment bag. Fastening apparatus for fastening the fourth panel in an open position may also be included in the garment bag.

The foregoing and other objectives, features, and advantages of the invention will be more readily understood upon consideration of the following detailed description of the invention, taken in conjunction with the accompanying drawings.

DETAILED DESCRIPTION OF THE PREFERRED EMBODIMENT

Figure 1:
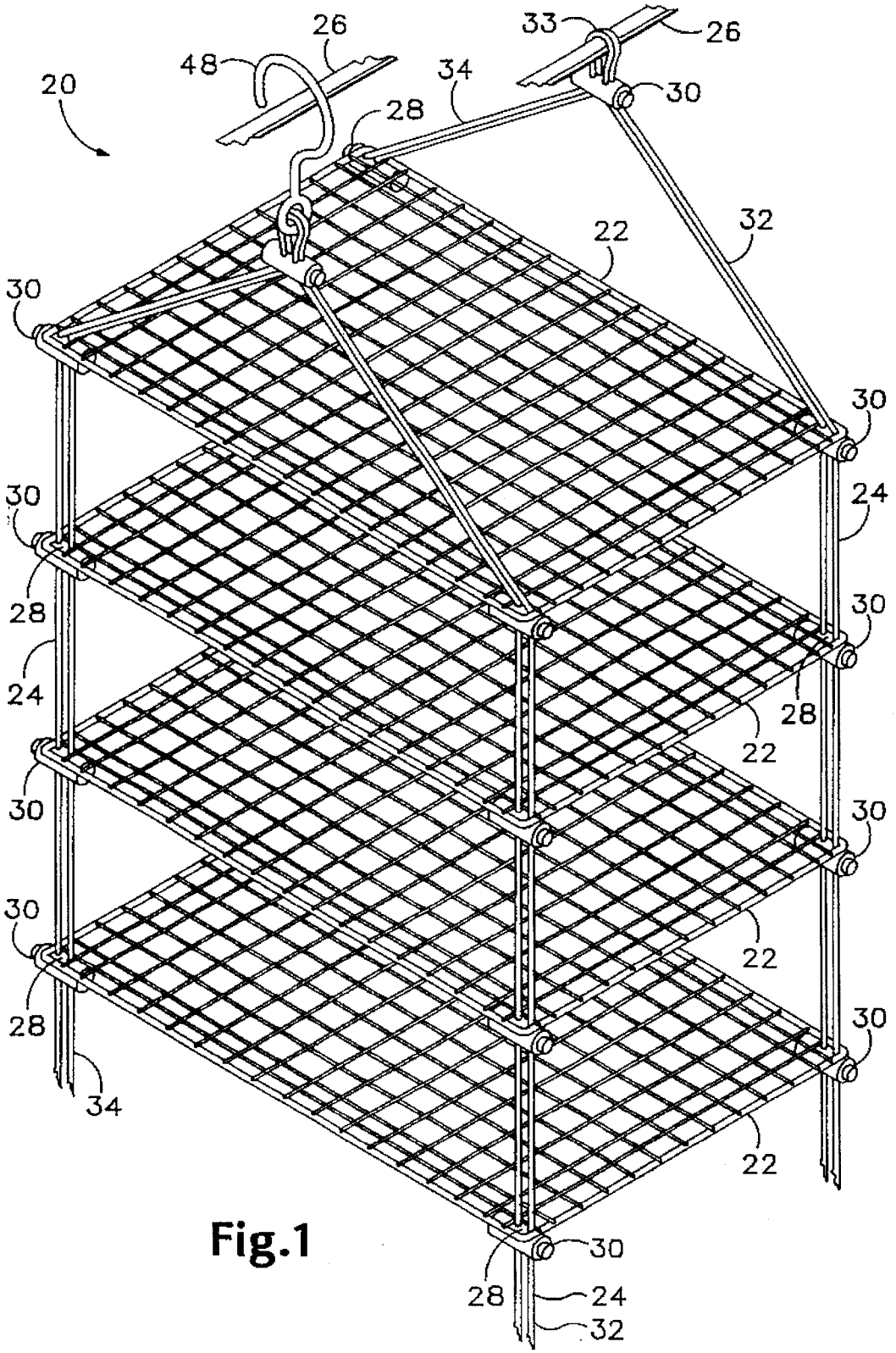
FIG. 1 is a perspective view of an exemplary embodiment of suspended adjustable shelving of the present invention.

An exemplary embodiment of suspended adjustable shelving, indicated generally as 20, is shown in FIG. 1. The shelving 20 includes multiple generally rectangular shelves 22 adjustably positioned at desired locations on vertical suspenders 24 which may be directly (FIG. 1) or indirectly (FIGS. 1 and 2) suspended from a cross-member 26 such as those usually found in closets or garment racks.

Each shelf 22 has at least one shelf aperture 28 located generally in each corner. The embodiment shown includes wire mesh shelves which have multiple apertures. The vertical suspenders 24, which may include a pair of ropes, pass through respective shelf apertures 28 of the shelves 22. Each shelf 22 is adjustably supported by a set of adjustable shelf fasteners 30 which are releasably attached to respective suspenders 24 below respective shelf apertures 28 through which the suspenders 24 pass. The height of each shelf 22 may be adjusted by raising or lowering the supporting set of fasteners 30. Shelves 22 may be added or removed by adding or removing shelves 22 and respective sets of fasteners 30.

As shown in FIG. 1, the vertical suspenders 24 may be four suspenders which include opposite halves (front 32 and back 34) of a pair of divided suspenders. In this embodiment, the front half 32 and back half 34 are divided at an approximate middle point 33 which is directly or indirectly attached to a cross-member 26. From the middle point 33, the front and back halves (32 and 34) slope towards the respective corners of the shelf 22 at the highest position along the suspenders 24.

Figure 4:
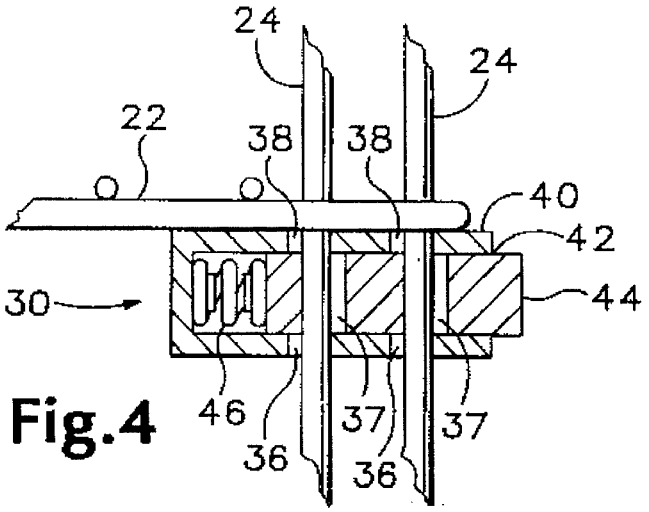
FIG. 4 is an enlarged cross-sectional side view of a shelf spring fastener.

The adjustable shelf fasteners 30 (shown in detail in FIG. 4) include at least one fastener aperture (36–38) through which suspenders 24 may pass, but preferably include a pair of fastener apertures (36–38) through which the respective rope of the pair of ropes of each suspender 24 may pass.

A preferred embodiment of the adjustable shelf fastener 30 includes an outer shell 40 having an opening 42 at one end and at least one set of aligned top and bottom apertures 36 and 38. A central member 44 including a middle aperture 37, is movably positioned within the outer shell 40 so that one end of the central member 44 protrudes from the opening 42 of the outer shell 40. A spring 46 is positioned between the outer shell 40 and the central member 44 to provide tension. Shelf fasteners of this type are known in the prior art.

A vertical suspender 24 may be inserted into and adjusted when a fastener 30 is in an open position. A fastener 30 is put in the open position by applying pressure to the protruding end of the central member 44 against the resistance of the spring 46, and pushing it into the outer shell 40. In this open position the top, middle, and bottom apertures (36–38) are in alignment and the vertical suspender 24 may be inserted. Further, the fastener 30 may be adjusted to the desired location along the vertical suspender 24 while the fastener 30 in this open position. When the fastener 30 is in the desired location, the central member 44 may be released so that the fastener is in a closed position. The spring 46 expands to provide tension between the central member 44 and the outer shell 40 so that the top, middle, and bottom apertures (36–38) are no longer in alinement. In this closed position, the tension of the spring 46 causes the fastener 30 to grip the vertical suspender 24 and thereby remain at the desired location.

If the vertical suspenders 24 include pairs of ropes, and the fasteners 30 include pairs of fastener apertures (36–38), then one rope may be inserted into each respective aperture. This double rope/double aperture embodiment is desirable as it provides durability and stability.

The shelving 20, as shown in FIG. 1, may be directly suspended from a vertical cross-member 26 by positioning the middle points 33 of the suspenders 24 over the cross-member 26. A fastener 30 may further secure the cross-member 26 under the middle point 33. Alternatively, as also shown in FIG. 1, a hook 48 may be used to indirectly suspend the shelving 20 from the vertical cross-member 26. Another alternative, shown in FIG. 2, indirectly attaches the shelving 20 to the vertical cross-member 26 using clips 49 to attach the shelving 20 to the garment rack 50 structure discussed in U.S. Pat. No. 5,143,214 assigned to applicant, the disclosure of which is hereby incorporated herein by reference.

Figure 2:
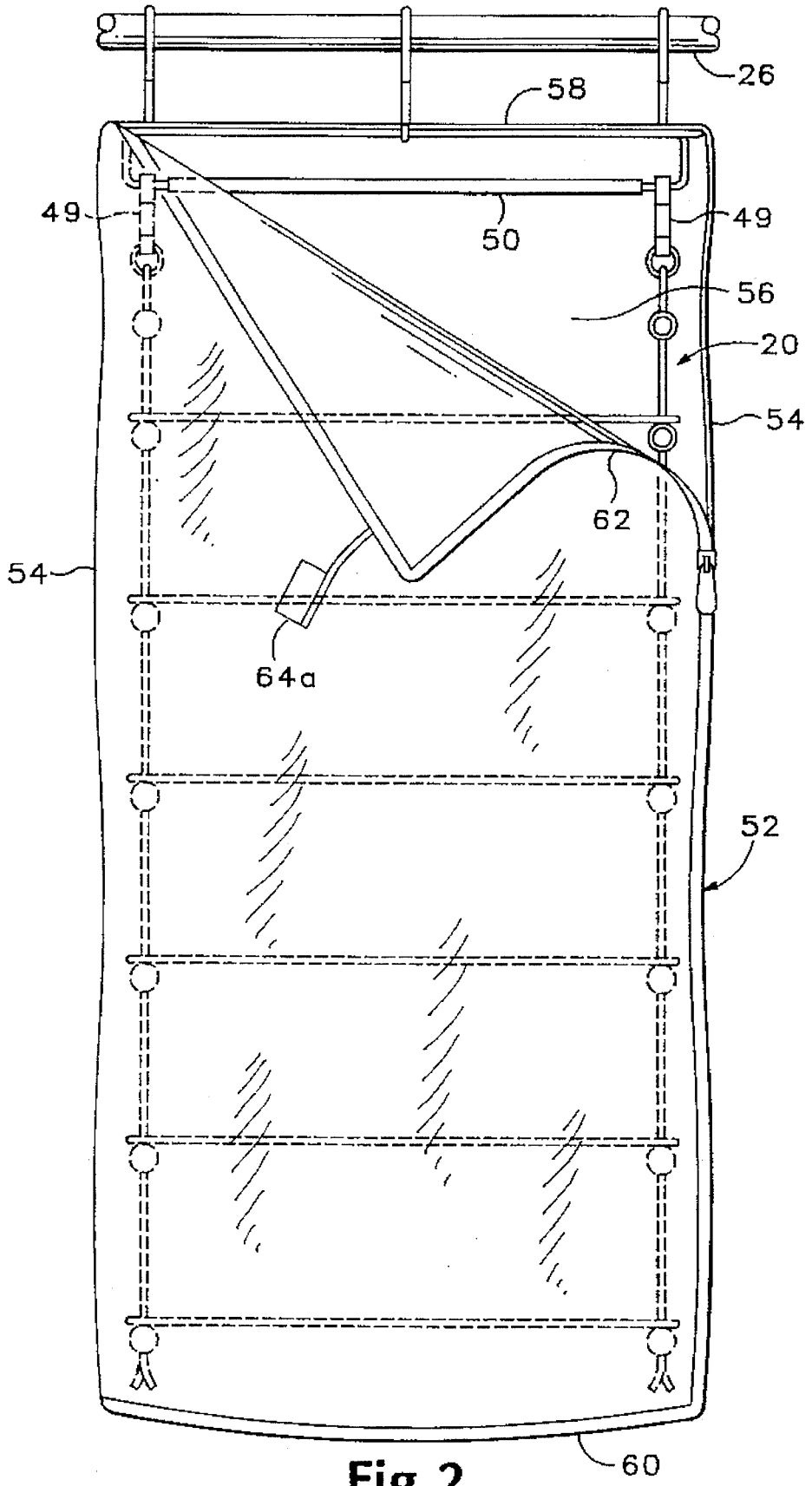
FIG. 2 is a front perspective view of the invention including an exterior garment bag.
Figure 3:
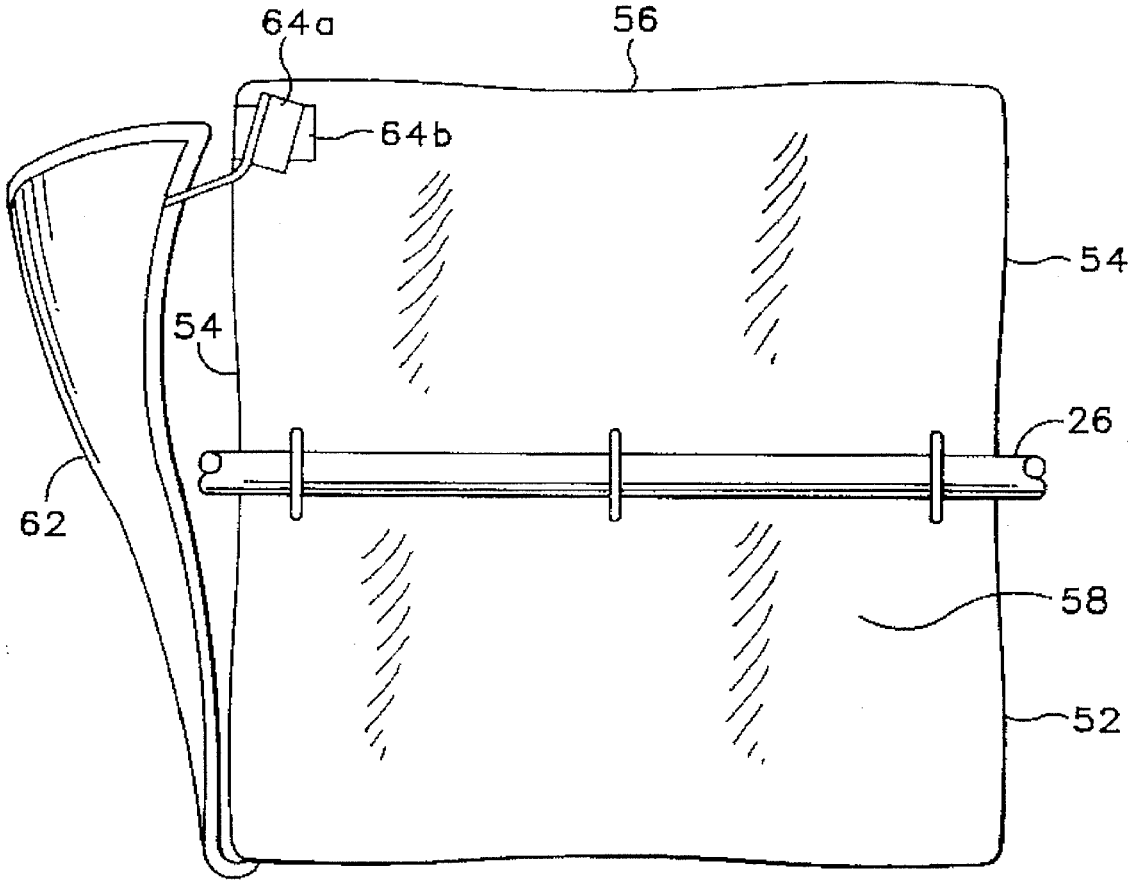
FIG. 3 is a top perspective view of the exterior garment bag in an open position.

Another embodiment, as shown in FIG. 2, includes an exterior garment bag 52 made of a flexible material such as fabric, plastic, or a combination of fabric and plastic. The garment bag 52 may be used to protect the contents of the shelving 20. The garment bag 52 may be constructed according to the applicant's U.S. Pat. No. 5,143,214 assigned to applicant, the disclosure of which is hereby incorporated herein by reference. Generally, as shown in FIGS. 2 and 3, the garment bag 52 includes at least three panels: two side panels 54 and a back panel 56. Top and bottom panels 58 and 60 may also be included in the garment bag 52.

A front panel 62, which may be made of clear plastic to allow easy viewing, may also be included in the garment bag 52. The front panel 62 should be at least partially removable. The front panel 62 preferably has a fastening mechanism **64*a* such as velcro, hooks, buttons, ties, or other known fasteners which mate with a related fastening mechanism 64*b* to fasten the fourth panel in an open position (shown from the top in FIG. 3**).

Alternative embodiments including shelves 22 of various shapes, different quantities of suspenders 24, and alternate apparatus for attaching the suspenders 24 to the cross-member 26 are incorporated herein.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. An adjustable shelving apparatus suspended from a cross-member, said adjustable shelving apparatus comprising:

(a) a plurality of shelves having at least four apertures;

(b) at least four vertical suspenders suspended from said cross-member, each suspender passing through respective apertures of said plurality of shelves, each suspender comprising a pair of ropes; and (c) a plurality of sets of adjustable shelf fasteners, each set including at least four adjustable shelf fasteners, one set for each shelf of said plurality of shelves, each fastener in a set releasably attached to a respective suspender of said at least four vertical suspenders to support a respective shelf at a desired location along said suspenders.

2. The adjustable shelving apparatus of claim 1, said at least four vertical suspenders being opposite halves of a pair of divided suspenders.

3. The adjustable shelving apparatus of claim 1, said adjustable shelf fasteners including a pair of apertures, a first rope of said pair of ropes passing through a first aperture of said pair of apertures, and a second rope of said pair of ropes passing through a second aperture of said pair of apertures.

4. The adjustable shelving apparatus of claim 1, said at least four vertical suspenders being opposite halves of a pair of divided suspenders, each pair of divided suspenders comprising a pair of ropes.

5. The adjustable shelving apparatus of claim 1, said plurality of shelves being wire mesh shelves.

6. The adjustable shelving apparatus of claim 1, said adjustable shelf fasteners being spring loaded fasteners.

7. The adjustable shelving apparatus of claim 1, said adjustable shelf fasteners including at least one aperture through which at least one of said vertical suspenders passes.

8. The adjustable shelving apparatus of claim 1, further comprising an exterior garment bag having at least three panels.

9. The adjustable shelving apparatus of claim 8 wherein said exterior garment bag is fabric.

10. The adjustable shelving apparatus of claim 8 wherein said exterior garment bag is plastic.

11. The adjustable shelving apparatus of claim 8 wherein said exterior garment bag includes a fourth panel, said fourth panel being at least partially removable.

12. The adjustable shelving apparatus of claim 11 wherein said fourth panel is clear.

13. The adjustable shelving apparatus of claim 11 wherein said fourth panel includes apparatus for fastening said fourth panel in an open position.

14. An adjustable shelving apparatus suspended from a cross-member, said adjustable shelving apparatus comprising:

(a) a plurality of shelves having at least four apertures;

(b) at least four suspenders suspended from said cross-member, each suspender passing through respective apertures of said plurality of shelves, each suspender including a first rope and a second rope; and (c) a plurality of sets of at least four adjustable spring fasteners, one set for each shelf of said plurality of shelves, each fastener in a set releasably attached to a respective suspender to support a respective shelf of said plurality of shelves, each fastener including first and second bores, said first rope passing through said first bore and said second rope passing through said second bore, said fastener including a spring to provide gripping tension to said ropes within said bores.

15. The adjustable shelving apparatus of claim 14, further comprising an exterior garment bag having at least three panels.

16. The adjustable shelving apparatus of claim 15 wherein said exterior garment bag includes a fourth panel, said fourth panel being at least partially removable.

17. The adjustable shelving apparatus of claim 16 wherein said fourth panel includes apparatus for fastening said fourth panel in an open position.

18. An adjustable shelving apparatus suspended from a cross-member, said adjustable shelving apparatus comprising:

(a) at least two pairs of ropes, said at least two pairs of ropes each divided at a central point by a suspending apparatus to form at least four suspenders each having a first rope and a second rope;

(b) said at least four suspenders suspended from said cross-member by a suspending apparatus;

(c) a plurality of shelves having at least four apertures, said at least four suspenders passing through respective apertures of said plurality of shelves;

(d) a plurality of sets of at least four adjustable spring fasteners, one set for each shelf of said plurality of shelves, each fastener in a set adjustably attached to a respective suspender to support a respective shelf of said plurality of shelves, each fastener including a first bore and a second bore, said first rope passing through said first bore and said second rope passing through said second bore; and (e) an exterior garment bag having at least three panels enclosing said adjustable shelving apparatus.

19. The adjustable shelving apparatus of claim 18 wherein said suspending apparatus is said cross-member.

* * * * *